US010654296B2

(12) United States Patent
Iijima et al.

(10) Patent No.: US 10,654,296 B2
(45) Date of Patent: May 19, 2020

(54) PRINTING APPARATUS

(71) Applicant: Brother Kogyo Kabushiki Kaisha, Nagoya-shi, Aichi-ken (JP)

(72) Inventors: Shota Iijima, Nagoya (JP); Kentaro Murayama, Kasugai (JP); Takanori Izumi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/233,885

(22) Filed: Dec. 27, 2018

(65) Prior Publication Data

US 2019/0263150 A1 Aug. 29, 2019

(30) Foreign Application Priority Data

Feb. 28, 2018 (JP) ..... 2018-034456

(51) Int. Cl.

| | |
|---|---|
| ***B41J 11/24*** | (2006.01) |
| ***B41J 11/02*** | (2006.01) |
| ***B41J 2/32*** | (2006.01) |
| ***B41J 11/04*** | (2006.01) |
| ***B41J 3/407*** | (2006.01) |
| ***B41J 2/325*** | (2006.01) |

(52) U.S. Cl.

CPC ..... *B41J 11/24* (2013.01); *B41J 2/32* (2013.01); *B41J 2/325* (2013.01); *B41J 3/4075* (2013.01); *B41J 11/02* (2013.01); *B41J 11/04* (2013.01)

(58) Field of Classification Search

CPC . B41J 11/24; B41J 2/325; B41J 3/4075; B41J 11/04; B41J 2/32; B41J 11/02

See application file for complete search history.

(56) References Cited

U.S. PATENT DOCUMENTS 5,631,690 A * 5/1997 Tashiro ..... B41J 2/32 347/220

2006/0198680 A1 9/2006 Yamamoto et al.

FOREIGN PATENT DOCUMENTS

JP 2006-239912 A 9/2006

* cited by examiner

*Primary Examiner* — Justin Seo

(74) *Attorney, Agent, or Firm* — Banner & Witcoff, Ltd.

(57) ABSTRACT

A printing apparatus, including: a head holder; a platen roller; a first support shaft; a roller holder; a moving mechanism configured to move the roller holder; and a biasing member configured to bias the roller holder in an inclined direction inclined with respect to a first direction which is substantially orthogonal to a conveyance direction and in which the roller faces a thermal head toward a second direction side, the second direction opposite to the conveyance direction, wherein, in a state in which the roller holder is located at a pressing position, the roller is held in contact with the head while receiving a biasing force in the first direction from the biasing member, and a first contact portion of the roller holder is held in contact with the head holder in the second direction while receiving a biasing force in the second direction from the biasing member.

9 Claims, 7 Drawing Sheets

PRINTING APPARATUS

CROSS REFERENCE TO RELATED APPLICATION

The present application claims priority from Japanese Patent Application No. 2018-034456, which was filed on Feb. 28, 2018, the disclosure of which is herein incorporated by reference in its entirety.

BACKGROUND

Technical Field

The following disclosure relates to a printing apparatus configured to perform printing by a thermal head.

Description of Related Art

A known printing apparatus performs printing such that an ink ribbon is heated by a thermal head so as to transfer ink of the ink ribbon to a printing medium. The ink ribbon superposed on the printing medium is pushed onto the thermal head by a platen roller. For instance, a tape printer including a thermal head, a platen roller, and a roller holder is known. The roller holder rotatably holds the platen roller at a position at which the platen roller faces the thermal head. The roller holder is pivotable about a holder shaft between a pressing position at which the platen roller is located close the thermal head and a retracted position at which the platen roller is located away from the thermal head.

SUMMARY

The accuracy of a positional relationship between the platen roller and the thermal head when the roller holder is located at the pressing position influences printing quality. In the structure described above, the accuracy of the positional relationship between the platen roller and the thermal head depends on part accuracy and assembling accuracy of components. Thus, in the case where part accuracy and assembling accuracy are enhanced for improving printing quality, the apparatus cost is undesirably increased.

Accordingly, an aspect of the disclosure is directed to a printing apparatus capable of enhancing the accuracy of the positional relationship between the platen roller and the thermal head with a simple structure and maintaining good printing quality.

In ones aspect of the disclosure, a printing apparatus includes: a frame: a thermal head configured to perform printing on a printing medium; a head holder holding the thermal head and fixed to the frame; a platen roller opposed to the thermal head and configured to convey the printing medium in a predetermined conveyance direction with the printing medium nipped by and between the platen roller and thermal head; a first support shaft fixed to the frame; a roller holder rotatably supporting the platen roller, pivotally supported by the first support shaft, and including a first contact portion contactable with the head holder; a moving mechanism configured to move the roller holder between a pressing position at which the platen roller is located close to the thermal head and a retracted position at which the platen roller is located away from the thermal head; and a biasing member configured to bias the roller holder in an inclined direction that is inclined with respect to a first direction toward a second direction side, the first direction being a direction which is substantially orthogonal to the conveyance direction and in which the platen roller faces the thermal head, the second direction being opposite to the conveyance direction, wherein the roller holder is configured such that, in a state in which the roller holder is located at the pressing position, the platen roller is held in contact with the thermal head while receiving a biasing force in the first direction from the biasing member, and the first contact portion is held in contact with the head holder in the second direction while receiving a biasing force in the second direction from the biasing member.

BRIEF DESCRIPTION OF THE DRAWINGS

The objects, features, advantages, and technical and industrial significance of the present disclosure will be better understood by reading the following detailed description of an embodiment, when considered in connection with the accompanying drawings, in which.

DETAILED DESCRIPTION OF THE EMBODIMENT

Figure 1:
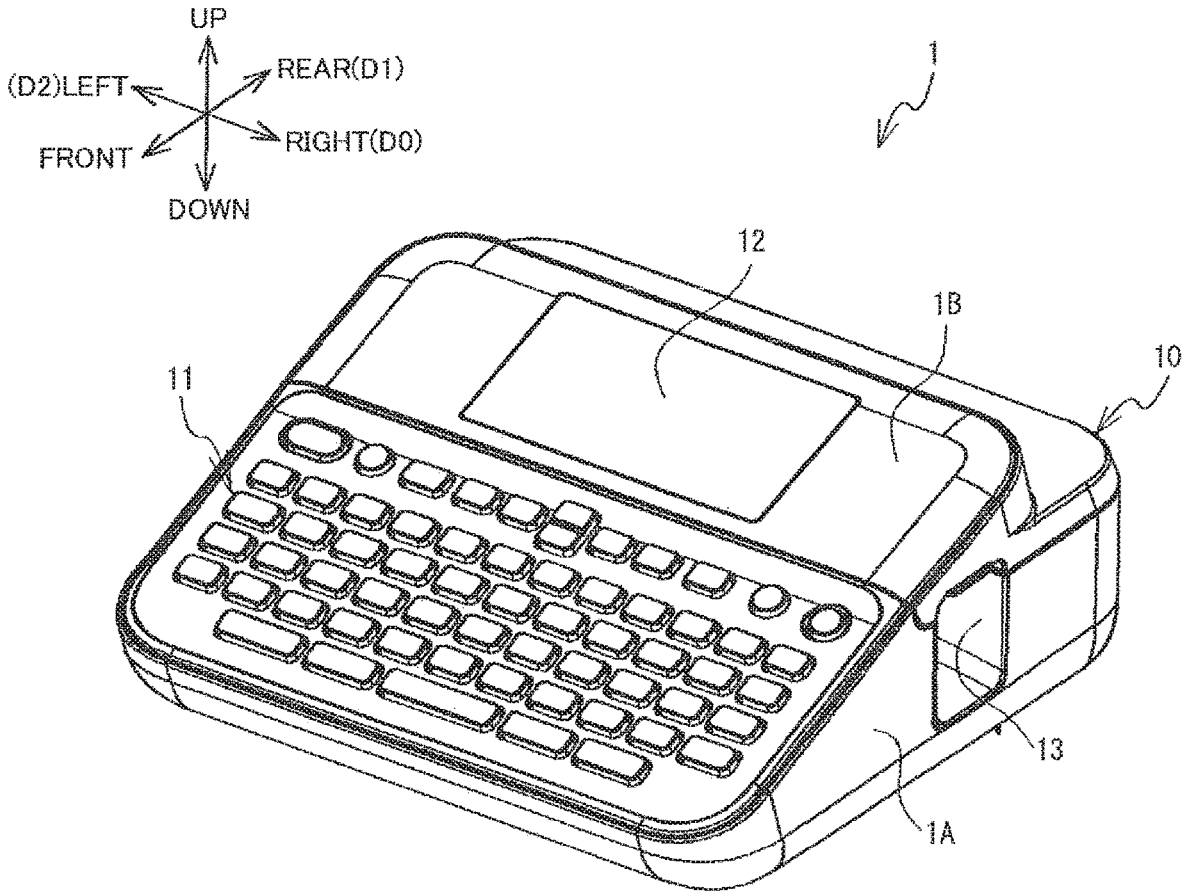
FIG. 1 is a perspective view of a printing apparatus in a state in which a lid is closed.
Figure 2:
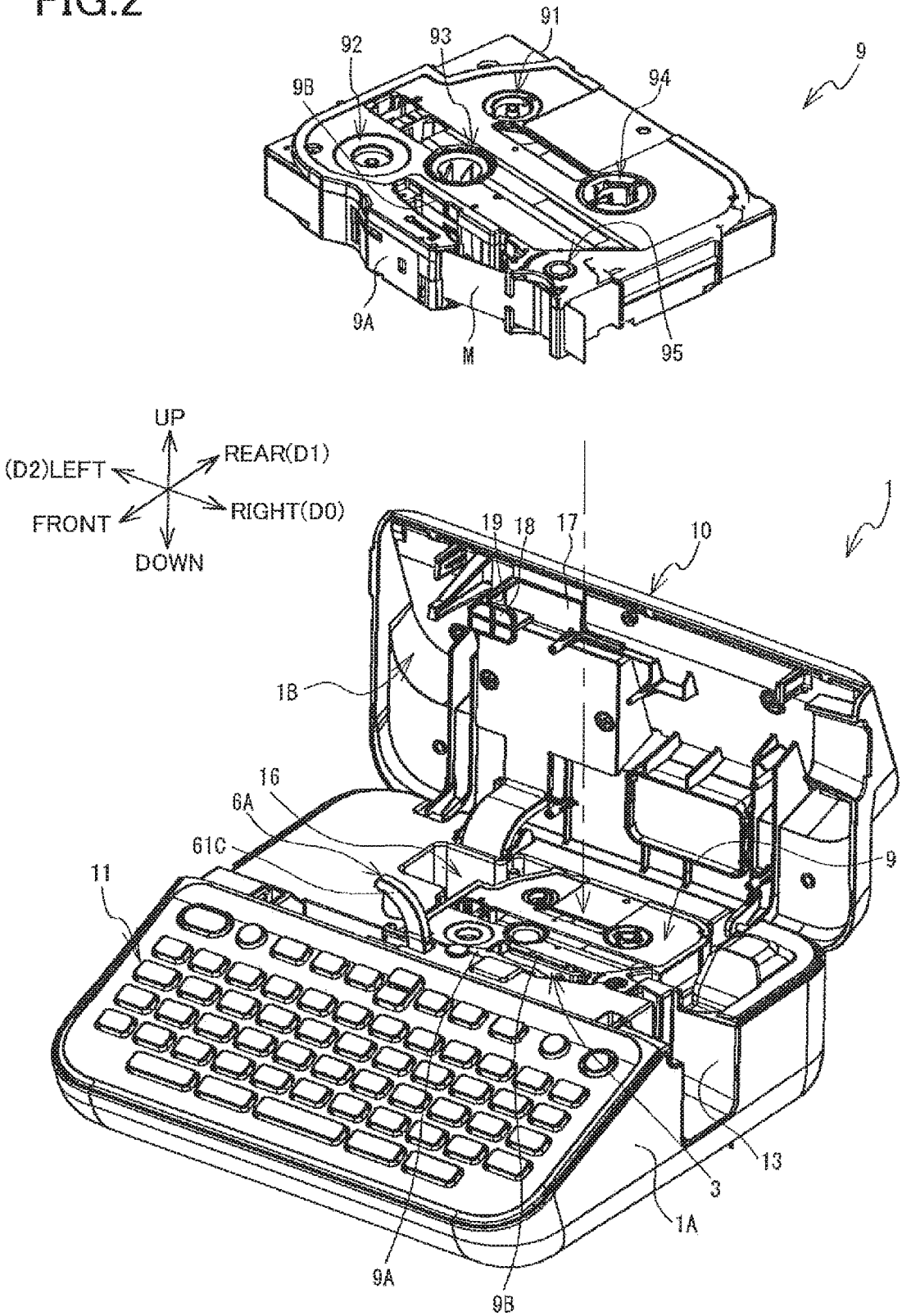
FIG. 2 is a perspective view of a cassette and the printing apparatus in a state in which the lid is open.

A printing apparatus 1 according to one embodiment will be hereinafter described with reference to the drawings. The printing apparatus 1 shown in FIG. 1 is a thermal transfer printer. The printing apparatus 1 performs printing such that a thermal head 3B (FIG. 4) heats an ink ribbon so as to transfer ink of the ink ribbon to a printing medium, e.g., a laminate tape M (FIG. 2) in the present embodiment. As shown in FIG. 2, the printing apparatus 1 is used with a cassette 9 installed on the accommodating portion 16. In the following explanation, a lower left side, an upper right side, an upper left side, a lower right side, an upper side, and a lower side in FIG. 1 are respectively defied as a front side, a rear side, a left side, a right side, an upper side, and a lower side of the printing apparatus 1. The definition of the directions of the printing apparatus 1 is also applied to the cassette 9 assuming that the cassette 9 is installed on the printing apparatus 1.

Overall Configuration of Printing Apparatus

As shown in FIG. 1, the printing apparatus 1 includes a housing 10 having a rectangular parallelepiped shape. The housing 10 includes a body cover 1A and a lid 1B. A key board 11 for inputting character strings and the like is provided at a front portion of an upper surface of the body cover 1A. The key board 11 includes a power switch, alphabetic and numeric keys, cursor keys, and so on. A discharge opening 13 through which a printed tape (which will be described) is discharged to an outside of the body cover 1A is formed in a right surface of the body cover 1A. As shown in FIG. 2, an opening is formed at a rear portion of the upper surface of the body cover 1A. The accommodating portion 16 for accommodating the cassette 9 (which will be described) is formed under the opening of the body cover 1A. The body cover 1A rotatably supports, at its rear end portion, the lid 1B. The lid 1B is configured to open and close the opening of the body cover 1A. FIG. 1 shows a state in which the lid 1B closes the opening. FIG. 2 shows a state in which the lid 1B exposes the opening. As shown in FIG. 1, the lid 1B is provided with a display 12 on which various kinds of information are displayed. Hereinafter, one of opposite surfaces of the lid 1B on which the display 12 is provided will be referred to as a front surface and the other of the opposite surfaces will be referred to as a back surface.

As shown in FIG. 2, the lid 1B is provided with, on its back surface, a pressing portion 17 for pressing a lever 6A downward when the lid 1B is closed and a pulling portion 18 for pulling the lever 6A up when the lid 1B is opened. The pulling portion 18 is provided to the right of a distal end of a protruding wall 19 that protrudes from a left end of the pressing portion 17. The pressing portion 17 and the pulling portion 18 are substantially parallel to each other. A length of the pulling portion 18 in a right-left direction is substantially half a length of the pressing portion 17 in the right-left direction. An extending portion 61C of the lever 6A is insertable into and withdrawable from a space defined between the pressing portion 17 and the pulling portion 18. The lever 6A and the extending portion 61C will be later explained in detail.

Cassette 9

As shown in FIG. 2, the cassette 9 is shaped like a box having a generally rectangular shape in plan view. The cassette 9 includes, at its front surface portion, an arm portion 9A protruding rightward. A portion of the cassette 9 defined by the arm portion 9A and a wall portion facing the arm portion 9A has a U-like shape in plan view, and a head opening 9B is defined by the U-like portion. A head holder 3 is inserted into the head opening 9B in a state in which the cassette 9 is accommodated in the accommodating portion 16 of the printing apparatus 1.

The cassette 9 includes supports 91, 92, 93, 94 and a feed roller 95, a detailed illustration of which is dispensed with. The support 91 rotatably supports a laminate tape roll which is formed by rolling a transparent laminate tape M. The support 92 rotatably supports a ribbon roll formed by rolling an ink ribbon before being heated. The support 93 rotatably supports a take-up shaft that takes up the ink ribbon after being heated. The support 94 rotatably supports an adhesive tape roll formed by rolling an adhesive tape. The adhesive tape is constituted by a base, adhesive layers formed by applying an adhesive to both sides of the base, a release sheet attached to a surface of one of the adhesive layers. The adhesive tape is formed into the roll with the release sheet exposed outside. The feed roller 95 is shaped like a cylindrical column extending in an up-down direction. The feed roller 95 is rotatably supported by the cassette 9. The laminate tape M is one example of a printing medium.

The adhesive tape drawn from the adhesive tape roll extends forward from the adhesive tape roll, is bent rightward by the feed roller 95, and extends in a direction in which the printed tape is discharged from the cassette 9. In this instance, the release sheet of the adhesive tape comes into contact with the feed roller 95. The laminate tape M drawn from the laminate tape roll extends forward from the laminate tape roll, is bent rightward, and passes through the arm portion 9A, so as to extend rightward. The laminate tape M is discharged from a right end of the arm portion 9A and passes in front of the head opening 9B. The laminate tape M is again supported in the vicinity of the feed roller 95 and comes into contact with the adhesive layer of the adhesive tape that is bent by the feed roller 95, so that the laminate tape M is attached to the adhesive tape. The laminate tape M to which the adhesive tape is attached is discharged from the cassette 9. The ink ribbon drawn from the ribbon roll extends rightward from the ribbon roll and passes through the arm portion 9A. The ink ribbon is discharged from the right end of the arm portion 9A and passes in front of the head opening 9B. In this instance, the ink ribbon is located behind the laminate tape M and is conveyed together with the laminate tape M. The ink ribbon is separated away from the laminate tape M in the vicinity of the feed roller 95 and returns into the cassette 9, so as to be taken up by the take-up shaft.

In directions in which the laminate tape M extends, a direction (a movement direction) in which the laminate tape M drawn from the laminate tape roll passes or moves in front of the head opening 9B will be hereinafter referred to as a conveyance direction D0 of the laminate tape M or simply referred to as a conveyance direction D0 where appropriate. The conveyance direction D0 corresponds to a rightward direction in the printing apparatus 1 and the cassette 9. A direction opposite to the conveyance direction D0 will be referred to as a second direction D2. The second direction D2 corresponds to a leftward direction in the printing apparatus 1 and the cassette 9.

Frame 2

Figure 3:
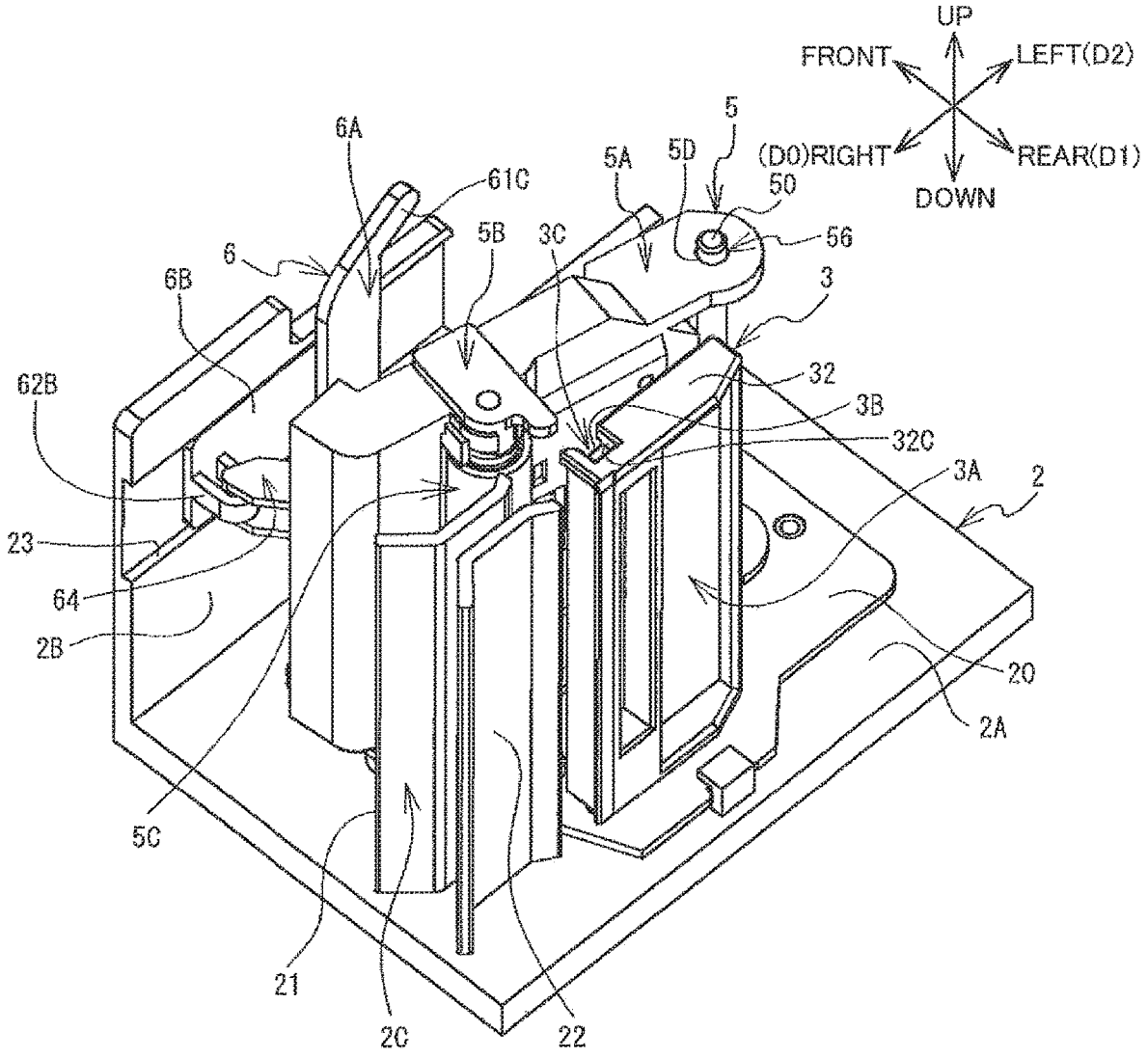
FIG. 3 is a perspective view of a frame, a head holder, a roller holder, and a moving mechanism viewed from a diagonally rear right side thereof.

As shown in FIG. 3, a frame 2 is provided in the accommodating portion 16 (FIG. 1) of the printing apparatus 1. The frame 2 is shaped like a bent plate including a base portion 2A and an upright portion 2B. The base portion 2A is substantially rectangular in plan view and perpendicular to the up-down direction. The upright portion 2B extends upward from a front end of the base portion 2A. The upright portion 2B is perpendicular to a front-rear direction. A groove 23 is formed in a rear surface of the upright portion 2B so as to extend in a right-left direction. A connector 6B of a moving mechanism 6 (which will be explained) engages with the groove 23 from behind.

A discharge portion 2C is formed so as to be located near a right end portion of the base portion 2A on the rear side of a center of the base portion 2A in the front-rear direction. The discharge portion 2C is disposed to the left of the discharge opening 13 (FIGS. 1 and 2) of the body cover 1A and to the right of a head holder 3 (which will be explained). The discharge portion 2C includes plates 21, 22 which are opposed in the front-rear direction. The plates 21, 22 are bent and opposed to each other with a space interposed therebetween in the front-rear direction. The discharge portion 2C introduces the printed tape (in which the printed laminate tape M and the adhesive tape are attached integrally to each other) in the conveyance direction D0 and guides the printed tape to the discharge opening 13.

Figure 4A:
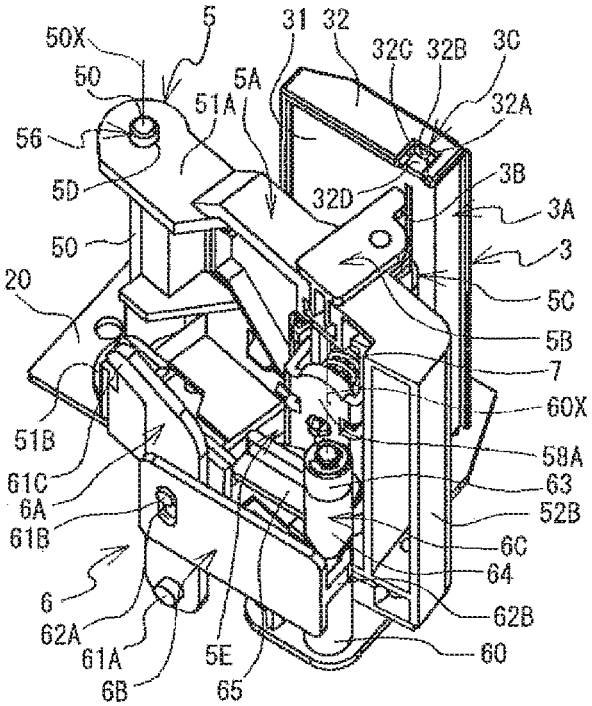
FIGS. 4A and 4B are perspective views of the head holder, the roller holder, and the moving mechanism viewed from a diagonally front right side thereof.
Figure 4A:
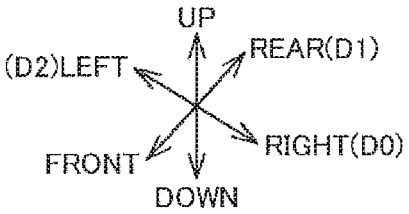

The base portion 2A holds, on its upper surface, a fixation plate 20. On the fixation plate 20, there are provided the head holder 3, a roller holder 5, a first support shaft 50, a second support shaft 60 (FIG. 4), and the moving mechanism 6. The first support shaft 50 shaped like a cylindrical column extends upward from an upper surface of the fixation plate 20 at a diagonally front left end portion of the fixation plate 20. As shown in FIG. 4, the second support shaft 60 shaped like a cylindrical column extends upward from the upper surface of the fixation plate 20 at a diagonally front right end portion of the fixation plate 20. The first support shaft 50 and the second support shaft 60 are fixed to the frame 2 via the fixation plate 20. The head holder 3, the roller holder 5, and the moving mechanism 6 will be later explained. The frame 2 is not illustrated in FIG. 4 for convenience in explanation.

Head Holder 3

As shown in FIG. 3, the head holder 3 is provided on the upper surface of the fixation plate 20 and fixed to the frame 2 via the fixation plate 20. The head holder 3 includes a plate-like support portion 3A. The support portion 3A is perpendicular to the front-rear direction and extends upward from the fixation plate 20. As shown in FIG. 4A, the thermal head 3B is held by a front surface 31 of the support portion 3A. The thermal head 3B is what is called a line thermal head including a plurality of heat generating elements arranged straight in the up-down direction.

A recess 3C is formed near a right end portion of an upper surface 32 of the support portion 3A so as to be recessed rearward from the front surface. The recess 3C is defined by wall portions 32A, 32B, 32C, 32D. The wall portions 32A, 32B, 32C, 32D respectively correspond to a leftward facing surface, a frontward facing surface, a rightward facing surface, and an upward facing surface of the recess 3C. While not shown, a recess which is identical in shape to the recess 3C is formed near a right end portion of a lower surface of the support portion 3A, which surface is opposed to the fixation plate 20.

Roller Holder 5

As shown in FIG. 3, the roller holder 5 is disposed in front of the head holder 3. The roller holder 5 holds a platen roller 5C. The platen roller 5C rotates in a state in which the laminate tape M and the ink ribbon are nipped by and between the platen roller 5C and the thermal head 3B held by the head holder 3, so as to convey the laminate tape M and the ink ribbon in the conveyance direction D0. The roller holder 5 includes a support portion 5A, a pair of bearing portions 5B, the platen roller 5C, and a spring holder 5E (FIG. 4).

As shown in FIGS. 4 and 5, the support portion 5A includes an upper plate 51A, a lower plate 51B, a side plate 52A (FIG. 5), and a side plate 52B each of which is shaped like a plate. The upper plate 51A and the lower plate 51B extend in the right-left direction. The upper plate 51A and the lower plate 51B are opposed to each other in the up-down direction. As shown in FIG. 5, the side plate 52A connects rear end portions of the respective upper plate 51A and lower plate 51B in the up-down direction. The side plate 52B connects right end portions of the respective upper plate 51A and lower plate 51B in the up-down direction. A right end of the side plate 52A and a rear end of the side plate 52B are connected integrally to each other.

Figure 4B:
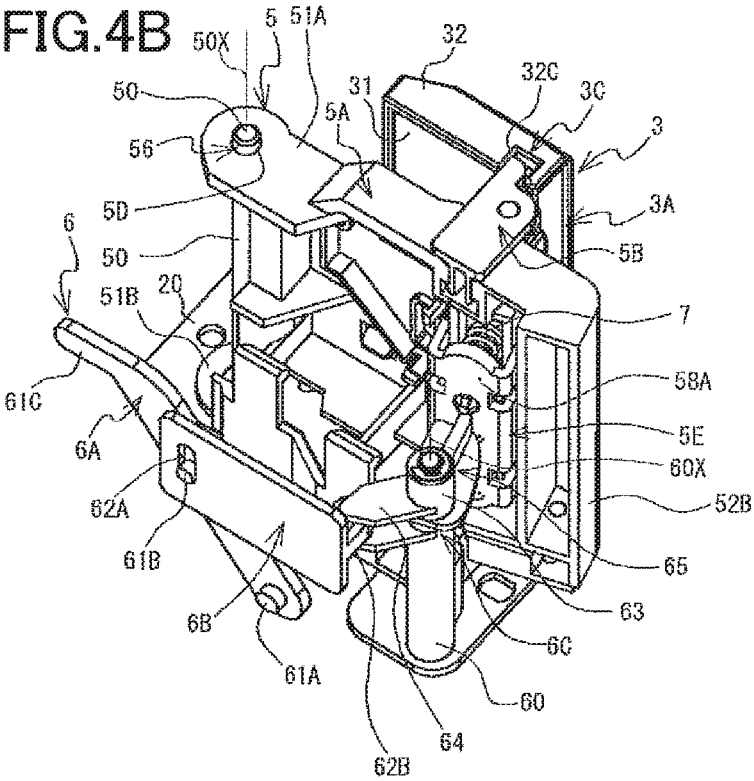
Figure 5A:
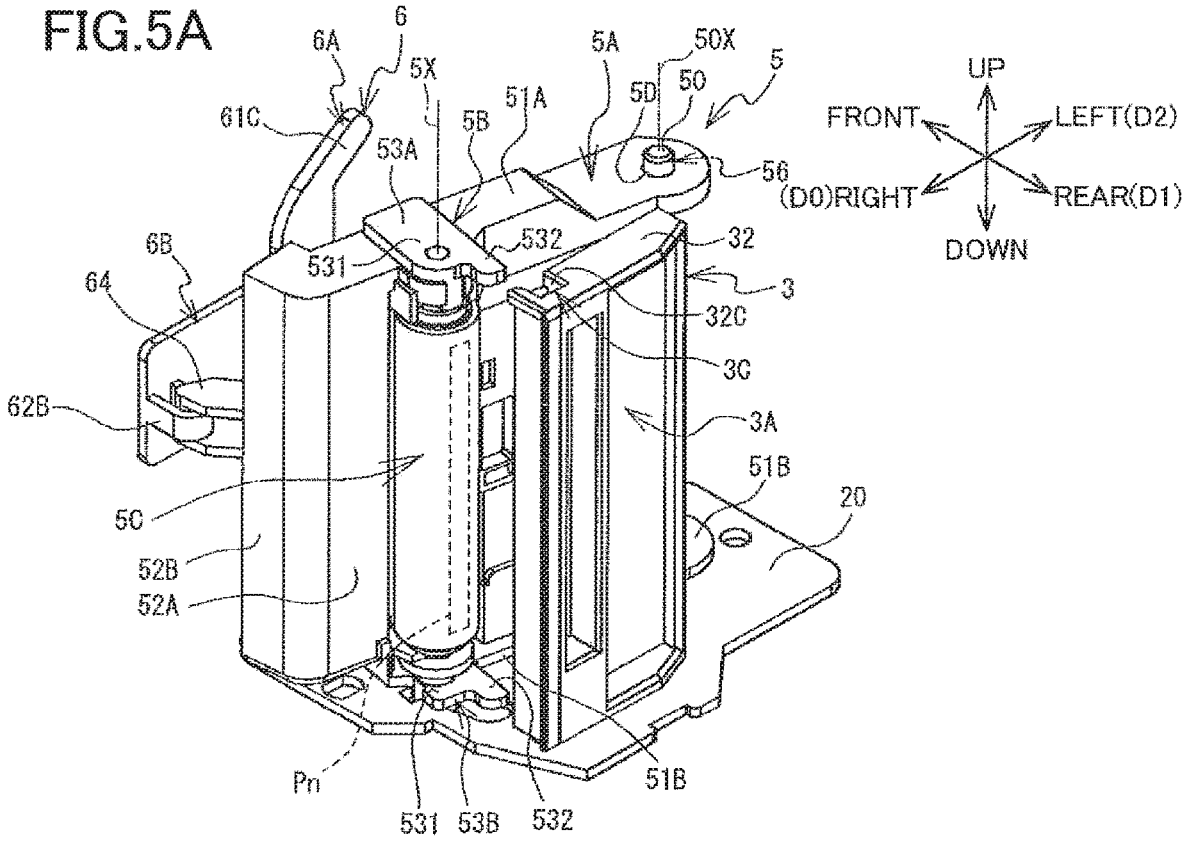
FIGS. 5A and 5B are perspective views of the head holder, the roller holder, and the moving mechanism viewed from a diagonally rear right side thereof.
Figure 5B:
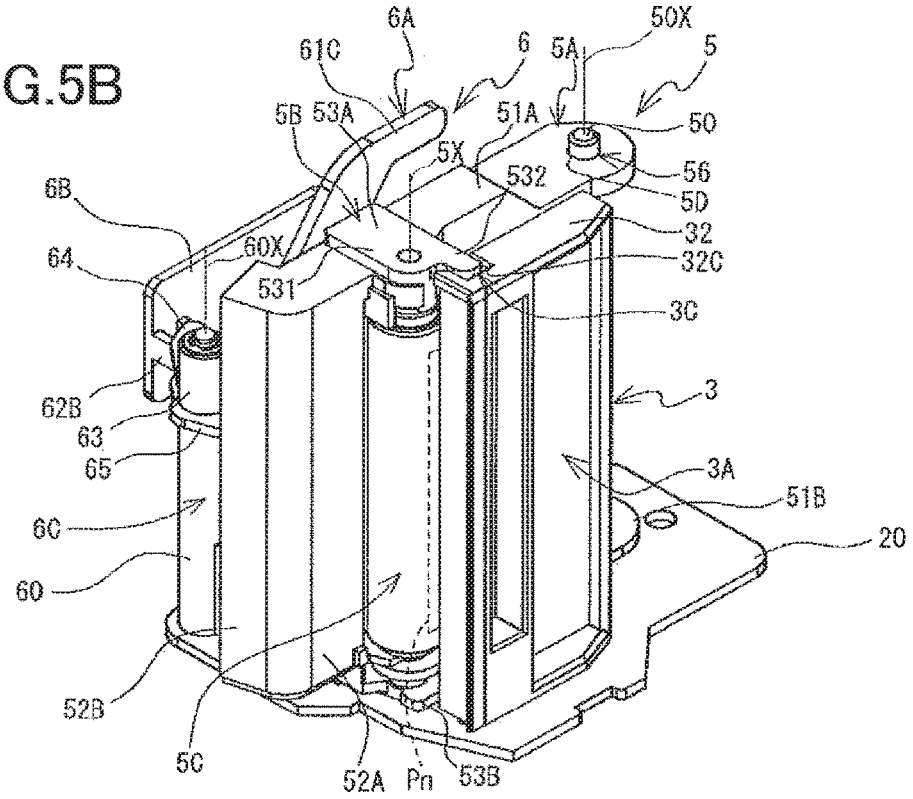
Figure 6:
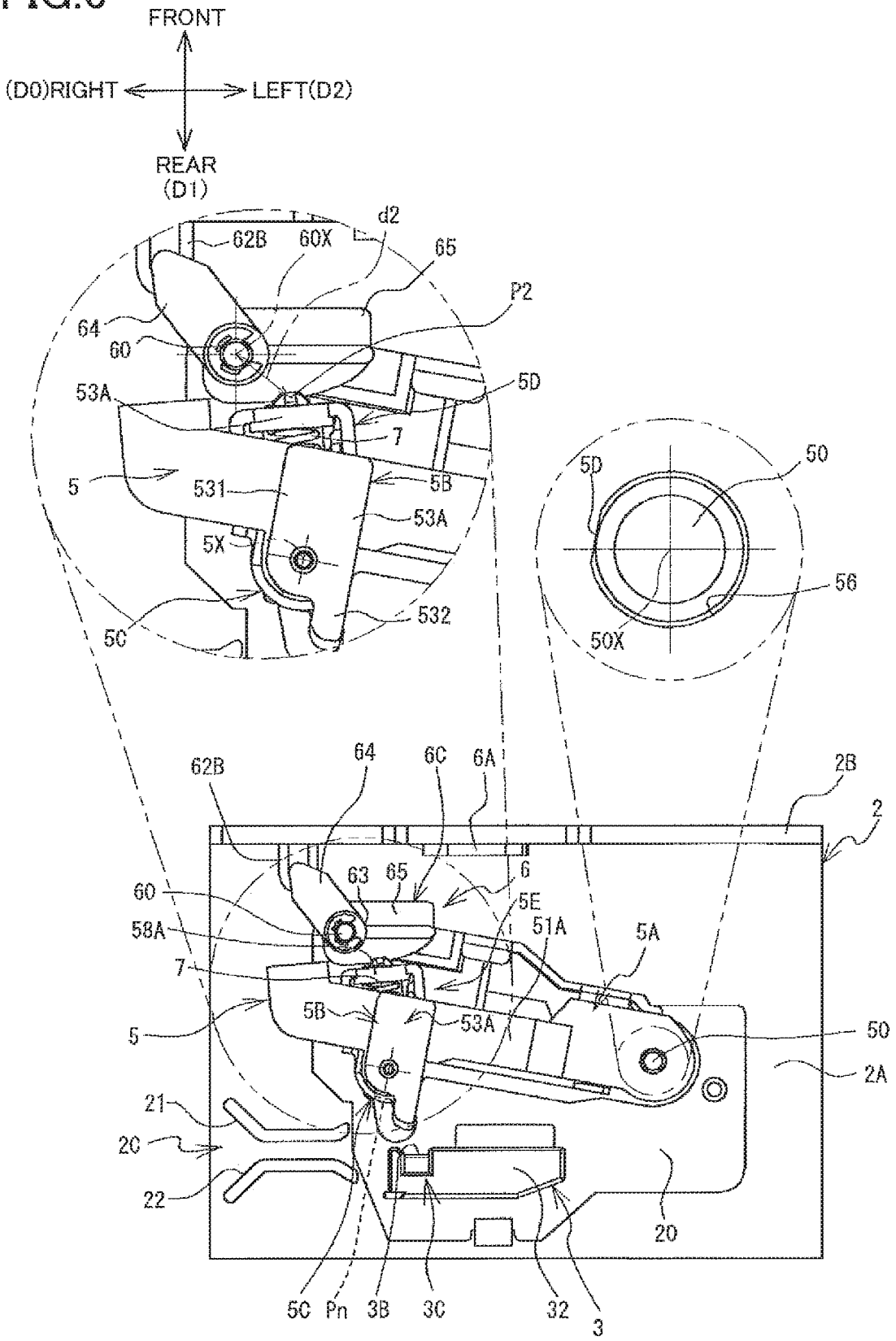
FIG. 6 is a plan view of the head holder, the roller holder (located at a retracted position), and the moving mechanism (located at a non-operative position)
Figure 7:
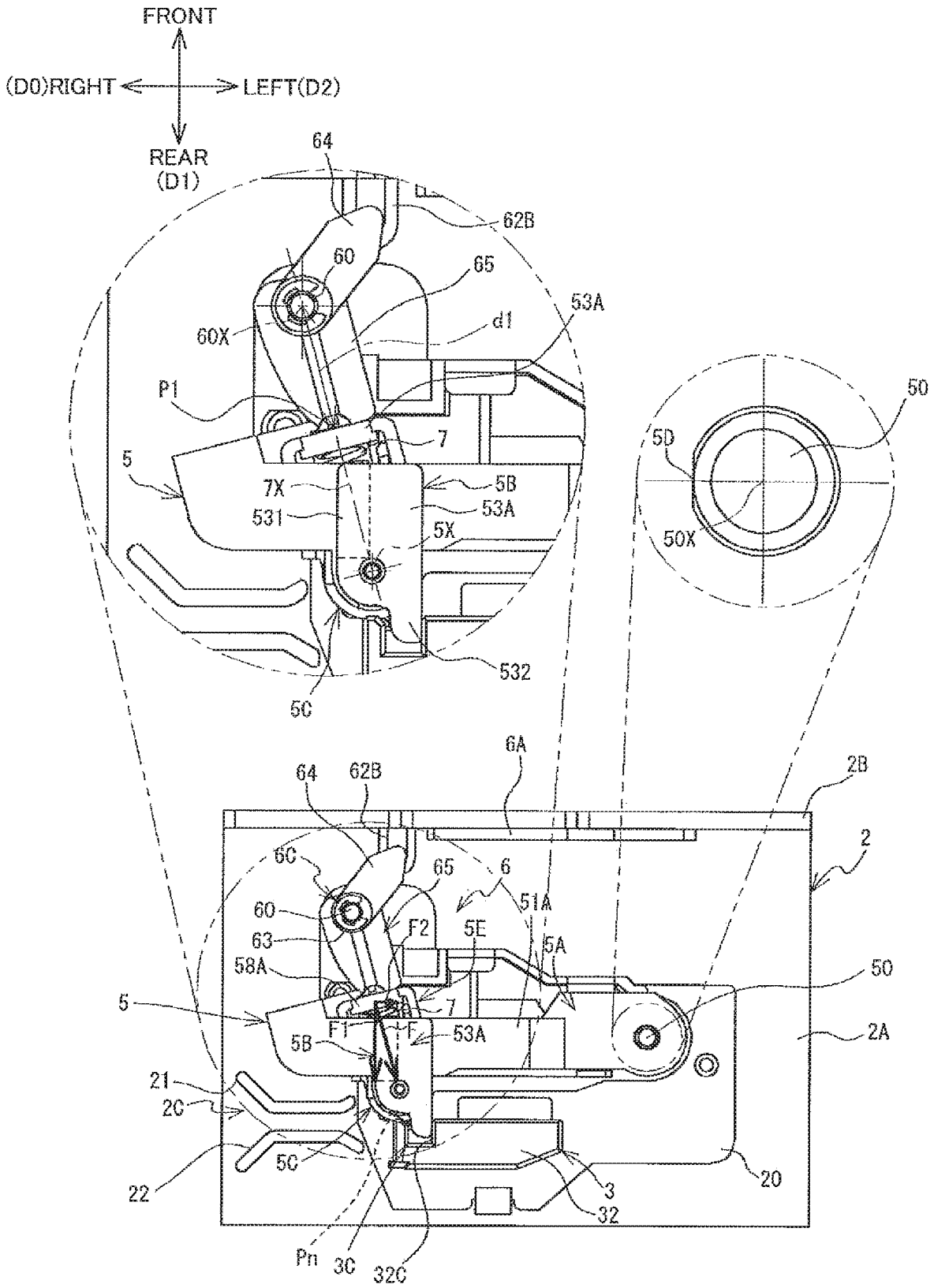
FIG. 7 is a plan view of the head holder, the roller holder (located at a pressing position), and the moving mechanism (located at an operative position).

A substantially circular through-hole 56 is formed at each of left end portions of the respective upper plate 51A and lower plate 51B of the support portion 5A so as to extend therethrough in the up-down direction. As shown in FIG. 6, in an inner circumferential surface of each through-hole 56, a part of its right end portion is flat without being curved. In other words, the inner circumferential surface of the through-hole 56 includes a flat portion formed in a part of a curved surface of a circle. Hereinafter, the flat portion of the through-hole 56 will be referred to as a partial flat portion 5D or simply referred to as a flat portion 5D. The flat portion 5D extends straight generally in the front-rear direction when the through-hole 56 is viewed from above. As shown in FIG. 4, the first support shaft 50 passes through the through-holes 56 of the respective upper plate 51A and lower plate 51B. The support portion 5A is supported so as to be rotatable about the first support shaft 50. FIGS. 4A, 5A, and 6 show a state, viewed from above, in which the support portion 5A is maximally rotated clockwise. FIGS. 4B, 5B, and 7 show a state, viewed from above, in which the support portion 5A is maximally rotated counterclockwise. The position of the roller holder 5 shown in FIGS. 4A, 5A, and 6 will be hereinafter referred to as a retracted position. The position of the roller holder 5 shown in FIGS. 4B, 5B, and 7 will be hereinafter referred to as a pressing position. A torsion spring (not shown) wound around the first support shaft 50 biases the roller holder 5 in a direction from the pressing position toward the retracted position.

As shown in FIG. 5, the pair of bearing portions 5B is constituted by bearing portions 53A, 53B. The bearing portion 53A is provided on an upper surface of the upper plate 51A, and the bearing portion 53B is provided on a lower surface of the lower plate 51B. The bearing portions 53A, 53B are shaped so as to be symmetrical with respect to a plane perpendicular to the up-down direction. Each of the bearing portions 53A, 53B includes a base portion 531 and a protruding portion 532. The base portion 531 is shaped like a plate and is perpendicular to the up-down direction. The protruding portion 532 protrudes rearward from a part of a rear end of the base portion 531, which part is located on the left side of a center of the rear end in the right-left direction. The platen roller 5C shaped like a cylinder is rotatably supported between the base portion 531 of the bearing portion 53A and the base portion 531 of the bearing portion 53B. A rotation axis 5X of the platen roller 5C extends in the up-down direction. Hereinafter, a direction which is perpendicular to the conveyance direction D0 and in which the platen roller 5C faces the thermal head 3B held by the head holder 3 will be referred to as a first direction D1. The first direction D1 corresponds to a rearward direction in the printing apparatus 1 and the cassette 9.

Compression Springs 7 and Spring Holder 5E

As shown in FIG. 4, compression springs 7 and a spring holder 5E holding the compression springs 7 are disposed on the front side of the side plate 52A (FIG. 5) of the support portion 5A. The spring holder 5E includes a plate-like holder portion 58A spaced forward from the side plate 52A. The holder portion 58A is held so as to be movable relative to the side plate 52A. A distance between the holder portion 58A and the side plate 52A changes in accordance with the movement of the holder portion 58A. The two compression springs 7 each in the form of a coil are provided between the holder portion 58A and the side plate 52A. The two compression springs 7 are identical in structure to each other and arranged in the up-down direction. In FIG. 4, a lower one of the two compression springs 7 is not illustrated. A rear end portion (as one example of one end portion) of each compression spring 7 is held in contact with a front surface of the side plate 52A. A front end portion (as one example of the other end portion) of each compression spring 7 is held in contact with a rear surface of the holder portion 58A of the spring holder 5E.

Moving Mechanism 6

As shown in FIG. 4, the moving mechanism 6 is disposed on the front side of the roller holder 5 and on the rear side of the upright portion 2B (FIG. 3) of the frame 2. The moving mechanism 6 causes the roller holder 5 to be moved between the retracted position and the pressing position in conjunction with opening and closing of the lid 1B. The moving mechanism 6 includes the lever 6A, the connector 6B, and a rotating portion 6C.

The lever 6A is shaped like an elongate plate. The lever 6A is perpendicular to the front-rear direction. A cylindrical protrusion 61A protruding frontward is provided on a front surface of the lever 6A so as to be located at one end of the lever 6A in its extension direction. The protrusion 61A is inserted, from behind, into a through-hole (not shown) formed in the upright portion 2B (FIG. 3) of the frame 2 (FIG. 3). The lever 6A is supported by the upright portion 2B so as to be rotatable about the protrusion 61A. FIGS. 4A and 5A show a state, viewed from the front side, in which the lever 6A is maximally rotated clockwise. FIGS. 4B and 5B show a state, viewed from the front side, in which the lever 6A is maximally rotated counterclockwise. As shown in FIG. 4, a cylindrical protrusion 61B protruding frontward is provided on the front surface of the lever 6A so as to be located substantially middle in its extension direction. The protrusion 61B is inserted, from behind, into an elongate hole 62A (which will be explained) of the connector 6B. The extending portion 61C is disposed at the other end of the lever 6A in its extension direction. The extending portion 61C extends in a direction inclined leftward with respect to the extension direction.

As shown in FIG. 4, the connector 6B is shaped like a rectangular plate. The connector 6B is perpendicular to the front-rear direction. The longitudinal direction of the connector 6B extends in the right-left direction. As shown in FIG. 3, the connector 6B engages, from behind, with a groove 23 formed in the rear surface of the upright portion 2B of the frame 2. The connector 6B is slidable in the right-left direction along the groove 23. FIGS. 4A and 5A show a state in which the connector 6B is maximally moved in the rightward direction. FIGS. 4B and 5B show a state in which the connector 6B is maximally moved in the leftward direction. As shown in FIG. 4, the elongate hole 62A that is elongate in the up-down direction is formed at a left end portion of the connector 6B. The protrusion 61B of the lever 6A is inserted into the elongate hole 62A in a direction from the rear side toward the front side. As shown in FIG. 5, a protrusion 62B protruding rearward is formed on a rear surface of the connector 6B at a right end portion thereof. The protrusion 62B is shaped like a curved plate and has a substantially U-like shape when viewed from above. The protrusion 62B has a through-hole defined by its inner surface and extending in the up-down direction. A link 64 (which will be explained) of the rotating portion 6C is held in engagement with the through-hole of the protrusion 62B.

As shown in FIG. 4, the rotating portion 6C includes a cylindrical member 63, the link 64, and a cam 65. The cylindrical member 63 having a cylindrical shape has a central through-hole extending in the up-down direction. The second support shaft 60 passes through the through-hole of the cylindrical member 63. The cylindrical member 63 is supported so as to be rotatable about the second support shaft 60. As shown in FIG. 6, the link 64 and the cam 65 are provided on the cylindrical member 63 and extend in the radial direction with the second support shaft 60 centered. The link 64 and the cam 65 extend in mutually different directions. When the cylindrical member 63 rotates, the link 64 and the cam 65 pivot about the second support shaft 60. FIGS. 4A, 5A, and 6 show a state, viewed from above, in which the link 64 and the cam 65 are maximally rotated counterclockwise. FIGS. 4B, 5B, and 7 show a state, viewed from above, in which the link 64 and the cam 65 are maximally rotated clockwise.

As shown in FIGS. 4 and 5, the link 64 includes two elongate plates opposed to each other in the up-down direction and a cylindrical portion (not shown) extending between the two elongate plates in the up-down direction at one end of each of the two elongate plates that is located farther from the cylindrical member 63. The cylindrical portion extends in the up-down direction. The cylindrical portion passes through the through-hole of the protrusion 62B of the connector 6B, whereby the link 64 is held in engagement with the protrusion 62B. As shown in FIG. 4, the cam 65 is plate-shaped cam having a shape which includes a part of an oval. The cam 65 is perpendicular to the up-down direction. An outer peripheral end portion of the cam 65 is partly in contact with the front surface of the holder portion 58A of the spring holder 5E. That is, the cam 65 is in contact with, via the spring holder 5E, the compression springs 7 that are in contact with the rear surface of the holder portion 58A of the spring holder 5E.

Hereinafter, a distance between: a portion of the outer peripheral end portion of the cam 65 at which the cam 65 contacts the holder portion 58A of the spring holder 5E; and an axis 60X of the second support shaft 60 will be referred to as a cam diameter. As shown in FIG. 6, in the state, viewed from above, in which the cam 65 is maximally rotated counterclockwise, the cam diameter corresponding to a distance between: a portion of the outer peripheral end portion of the cam 65 at which the cam 65 is in contact with the holder portion 58A of the spring holder 5E (hereinafter referred to as a second portion P2); and the axis 60X will be referred to as a second cam diameter d2. As shown in FIG. 7, in the state, viewed from above, in which the cam 65 is maximally rotated clockwise, the cam diameter corresponding to a distance between: a portion of the outer peripheral end portion of the cam 65 at which the cam 65 is in contact with the holder portion 58A of the spring holder 5E (hereinafter referred to as a first portion P1); and the axis 60X will be referred to as a first cam diameter d1. The first cam diameter d1 is larger than the second cam diameter d2. When viewed from above, the cam 65 has a shape that allows the cam diameter to continuously change between the first cam diameter d1 and the second cam diameter d2.

Hereinafter, the position of the moving mechanism 6 shown in FIGS. 4A, 5A, and 6 will be referred to as a non-operative position, and the position of the moving mechanism 6 shown in FIGS. 4B, 5B, and 7 will be referred to as an operative position. The moving mechanism 6 is movable between the non-operative position and the operative position.

Explanation of Operation Upon Closure of Lid 1B

As shown in FIG. 2, in the state in which the lid 1B is open, the moving mechanism 6 is located at the non-operative position (shown in FIGS. 4A, 5A, and 6). In this state, the extending portion 61C of the lever 6A of the moving mechanism 6 protrudes upward from the accommodating portion 16. When the moving mechanism 6 is located at the non-operative position, the roller holder 5 is located at the retracted position (shown in FIGS. 4A, 5A, and 6). As shown in FIGS. 4A, 5A, and 6, in the state in which the roller holder 5 is located at the retracted position, the platen roller 5C is spaced forward with respect to the thermal head 3B held by the head holder 3, and the protruding portions 532 of the respective bearing portions 53A, 53B are spaced forward with respect to the corresponding recesses 3C of the head holder 3.

In the process of switching from the open state of the lid 1B (FIG. 2) to the closed state thereof (FIG. 1), the pressing portion 17 of the lid 1B comes into contact with the lever 6A of the moving mechanism 6. Because the extending portion 61C of the lever 6A extends obliquely toward the upper left side, the extending portion 61C of the lever 6A receives, from the lid 1B, a leftward force by which the extending portion 61C of the lever 61 is moved leftward. In this case, as shown in FIG. 4, the lever 6A rotates about the protrusion 61A in a direction in which the extending portion 61C moves leftward (FIG. 4A→FIG. 4B). The protrusion 61B of the lever 6A moves leftward in accordance with the rotation of the lever 6A. The connector 6B that is held in engagement with the protrusion 61B moves leftward (FIG. 4A→FIG. 4B) along the groove 23 (FIG. 3) formed in the upright portion 2B of the frame 2. In this instance, the extending portion 61C of the lever 6A rotates in the direction in which the extending portion 61C moves leftward, so that the extending portion 61C enters the space between the pressing portion 17 and the pulling portion 18 of the lid 1B.

As shown in FIG. 4, the leftward movement of the connector 6B causes a distal portion of the link 64 engaged with the protrusion 62B to be moved leftward, whereby the rotating portion 6C is rotated about the second support shaft 60 clockwise when viewed from above (FIG. 4A→FIG. 4B). The rotation of the rotating portion 6C causes the cam 65 to pivot. The portion of the cam 65 at which the cam 65 contacts the holder portion 58A of the spring holder 5E changes from the second portion P2 shown in FIG. 6 to the first portion P1 shown in FIG. 7. In this instance, the cam diameter changes from the second cam diameter d2 (FIG. 6) to the first cam diameter d1 (FIG. 7), whereby the holder portion 58A moves in a direction away from the second support shaft 60 (FIG. 6→FIG. 7). In this way, the movement of the moving mechanism 6 from the non-operative position (FIGS. 4A, 5A, and 6) to the operative position (FIGS. 4B, 5B, and 7) in conjunction with the switching to the closed state of the lid 1B (FIG. 1) is completed.

When the moving mechanism 6 moves to the operative position and the holder portion 58A accordingly moves, the compression springs 7 disposed between the spring holder 5E and the roller holder 5 push the side plate 52A of the roller holder 5 (FIG. 5) rearward. Accordingly, the roller holder 5 is rotated about the first support shaft 50 counterclockwise when viewed from above (FIG. 4A→FIG. 4B). The rotation of the roller holder 5 causes the platen roller 5C shown in FIG. 5 to be moved forward so as to be located close to the thermal head 3B (FIG. 4) held by the head holder 3 (FIG. 5A→FIG. 5B). As shown in FIGS. 4B, 5B, and 7, the platen roller 5C is located in front of the thermal head 3B held by the head holder 3. Further, the cam 65 is pivoted to compress the compression springs 7 via the spring holder 5E. The compression springs 7 placed in a compression state push the side plate 52A of the roller holder 5 rearward, so as to bias the platen roller 5C. In this way, the movement of the roller holder 5 from the retracted position (FIGS. 4A, 5A, and 6) to the pressing position (FIGS. 4B, 5B, and 7) in conjunction with the movement of the moving mechanism 6 is completed.

As shown in FIG. 7, there is defined an imaginary straight line 7X extending along a center line of each compression spring 7 in the state in which the roller holder 5 is located at the pressing position. The imaginary straight line 7X passes the axis 60X of the second support shaft 60 and the rotation axis 5X of the platen roller 5C. The direction extending from the spring holder (5E) side toward the head holder (3) side along the imaginary straight line 7X is inclined with respect to the first direction D1 toward the second direction (D2) side by about 15 degrees, for instance. This inclined direction corresponds to a direction of a biasing force F that the roller holder 5 receives from the compression springs 7. Here, the inclined direction in which the roller holder 5 receives the biasing force F from the compression coil springs 7 is a direction that is inclined with respect to the first direction D1 such that the rear end portion of each compression spring 7 (that is in contact with the front surface of the side plate 52A of the roller holder 5) is located closer to an upstream side in the conveyance direction D0 than the front end portion of each compression spring 7 (that is in contact with the rear surface of the holder portion 58A of the spring holder 5E).

The roller holder 5 receives a biasing force F1 that acts in the first direction D1 due to the biasing force F of the compression springs 7. Accordingly, the platen roller 5C of the roller holder 5 comes into contact with the thermal head 3B held by the head holder 3 from the front side. Further, the roller holder 5 receives a biasing force F2 that acts in the second direction D2 due to the biasing force F of the compression springs 7. Accordingly, the protruding portions 532 of the roller holder 5 respectively come into contact with the wall portions 32C of the corresponding recesses 3C of the head holder 3 in the second direction D2. The roller holder 5 receives the biasing force F2 from the compression springs 7, whereby the flat portions 5D of the inner circumferential surfaces of the respective through-holes 56 of the roller holder 5 come into contact with the first support shaft 50 in the second direction D2.

As shown in FIG. 5, a portion of the platen roller 5C which contacts the thermal head 3B in the state in which the roller holder 5 is located at the pressing position will be referred to as a head contact portion Pn. The head contact portion Pn becomes a portion of the platen roller 5C located near its rear end in the state in which the roller holder 5 is located at the pressing position. Specifically, as shown in FIGS. 6 and 7, the head contact portion Pn is located on a diagonally front right side with respect to the protruding portions 532 of the bearing portions 5B when viewed in the up-down direction.

Explanation of Operation Upon Opening of Lid 1B

When the state of the lid 1B is changed from the closed state (FIG. 1) to the open state (FIG. 2), the pulling portion 18 of the lid 1B pulls the extending portion 61C of the lever 6A up. The lever 6A accordingly rotates about the protrusion 61A shown in FIG. 4 in a direction in which the extending portion 61C moves rightward, whereby the connector 6B of the moving mechanism 6 moves rightward and the rotating portion 6C of the moving mechanism 6 rotates counterclockwise when viewed from above. Further, the extending portion 61C of the lever 6A is disengaged from the right end of the pulling portion 18 toward the right side midway in the movement of the lid 1B to the open state.

The compression springs 7 disposed between the spring holder 5E and the roller holder 5 which have been in the compression state return to the original extended state. The roller holder 5 is moved from the pressing position to the retracted position (FIG. 4B→FIG. 4A) by the biasing force of the torsion spring (not shown). Further, the biasing force when the compression springs 7 return to the non-compressed state acts on the cam 65, whereby the rotating portion 6C is rotated counterclockwise when viewed from above (FIG. 4B→FIG. 4A). When the rotating portion 6C rotates, the link 64 moves the connector 6B rightward (FIG. 4B→FIG. 4A) along the groove 23 (FIG. 3) formed in the upright portion 2B of the frame 2. Further, the movement of the connector 6B causes the lever 6A to be rotated in a direction in which the extending portion 61C moves rightward (FIG. 4B→FIG. 4A). In this way, the movement of the moving mechanism 6 from the operative position (FIGS. 4B, 5B, and 7) to the non-operative position (FIGS. 4A, 5A, and 6) in conjunction with the switching to the open state of the lid 1B (FIG. 1) is completed. In the state in which the moving mechanism 6 is located at the non-operative position, the compression springs 7 are not compressed via the spring holder 5E, and the roller holder 5 is located at the retracted position.

Functions and Effects

According to the printing apparatus 1, when the roller holder 5 is located at the pressing position (FIGS. 4B, 5B, and 7), the protruding portions 532 of the respective bearing portions 5B are held in contact with the head holder 3 in the second direction D2. The direction of the counterforce that acts on the roller holder 5 when the platen roller 5C conveys the laminate tape M and the ink ribbon in the conveyance direction D0 coincides with the second direction D2. That is, the protruding portions 532 are held in contact with the head holder 3 in the same direction as the direction in which the counterforce acts. In this configuration, even when the counterforce acts on the head holder 3, the positional relationship between the thermal head 3B and the platen roller 5C can be maintained with high accuracy. Thus, the printing apparatus 1 maintains good printing quality. In the printing apparatus 1, the counterforce that acts on the roller holder 5 is received by both of the roller holder 5 and the head holder 3, whereby it is possible to effectively obviate a decrease in the accuracy of the positional relationship between the thermal head 3B and the platen roller 5C, as compared with a conventional arrangement in which the counterforce is received only by the roller holder 5.

In the state in which the roller holder 5 is located at the pressing position, the protruding portions 532 of the respective bearing portions 5B are held in contact with the wall portions 32C of the corresponding recesses 3C of the head holder 3 in the second direction D2 while receiving the biasing force F2 from the compression springs 7. This configuration easily achieves a configuration in which the protruding portions 532 are held in contact with the head holder 3 in the second direction D2 utilizing the protruding portions 532 and the recesses 3C.

The protruding portions 532 are located near the contact portion Pn of the platen roller 5C which is held in contact with the thermal head 3B in the state in which the roller holder 5 is located at the pressing position. In this configuration, the protruding portions 532 are held in contact with the head holder 3 near the contact portion Pn of the platen roller 5C. It is thus possible to increase the accuracy of the positional relationship between the platen roller 5C and the thermal head 3B at the contact portion Pn of the platen roller 5C.

The roller holder 5 has the through-holes 56 through which the first support shaft 50 passes. In the inner circumferential surface of each through-hole 56, a part of its right end portion is formed flat to provide the partial flat portion 5D. The roller holder 5 receives the biasing force F2 from the compression springs 7 in the state in which the roller holder 5 is located at the pressing position, whereby the partial flat portions 5D are held in contact with the first support shaft 50 in the second direction D2. This configuration reduces wobbling between the roller holder 5 and the first support shaft 50 by the contact of the partial flat portions 5D of the roller holder 5 with the first support shaft 50. Thus, even when there exists a clearance between the roller holder 5 and the first support shaft 50, the printing apparatus 1 is capable of maintaining, with high accuracy, the positional relationship between the thermal head 3B and the platen roller 5C. In the printing apparatus 1, it is possible to prevent or reduce wobbling between the roller holder 5 and the first support shaft 50 utilizing, as the partial flat portion 5D, a part of the inner circumferential surface of each through-hole 56 through which the first support shaft 50 passes in the roller holder 5, without a need of providing an additional structure. In this respect, because the partial flat portion 5D has a flat surface, it is relatively easy to enhance part accuracy in the manufacturing process, thus making it possible to effectively prevent or reduce wobbling between the roller holder 5 and the first support shaft 50.

In the printing apparatus 1, the compression springs 7 are disposed so as to extend in the inclined direction that is inclined with respect to the first direction D1 toward the second direction (D2) side. In other words, the rear end portion of each compression spring 7 that is held in contact with the side plate 52A of the support portion 5A of the roller holder 5 is located closer to the upstream side in the conveyance direction D0 than the front end portion of each compression spring 7 that is held in contact with the holder portion 58A of the spring holder 5E. The direction extending from the spring holder (5E) side toward the head holder (3) side along the imaginary straight line 7X passing the centerline of each compression spring 7 is inclined with respect to the first direction D1 toward the second direction (D2) side. This configuration enables the biasing force F of the compression springs 7 to act both in the first direction D1 and the second direction D2.

When the moving mechanism 6 is moved to the operative position, the cam 65 compresses the compression springs 7 via the holder portion 58A of the spring holder 5E. The compressed compression springs 7 bias the roller holder 5, so that the roller holder 5 is located at the pressing position. Thus, the movement of the moving mechanism 6 to the operative position causes the roller holder 5 to be located at the pressing position and at the same time causes the biasing force of the compression springs 7 to act on the roller holder 5. When the moving mechanism 6 is moved to the non-operative position, on the other hand, the spring holder 5E does not compress the compression springs 7, and the roller holder 5 is located at the retracted position. Thus, the movement of the moving mechanism 6 to the non-operative position allows the roller holder 5 to be located at the retracted position and at the same time prevents the biasing force of the compression springs 7 from acting on the roller holder 5.

The moving mechanism 6 includes the cam 65 supported so as to be pivotable about the second support shaft 60. When the moving mechanism 6 is moved from the non-operative position to the operative position, the cam 65 pivots by the rotation of the rotating portion 6C, and the cam diameter changes from the second cam diameter d2 (FIG. 6) to the first cam diameter d1 (FIG. 7). As a result, the holder portion 58A of the spring holder 5E moves away from the second support shaft 60, whereby the compression springs 7 are placed in the compressed state. The compressed compression springs 7 bias the roller holder 5. That is, the movement of the moving mechanism 6 to the operative position causes the cam 65 to pivot, whereby the compression springs 7 are compressed so as to apply the biasing force to the roller holder 5.

On the other hand, when the moving mechanism 6 is moved from the operative position to the non-operative position, the cam 65 pivots by the rotation of the rotating portion 6C, and the cam diameter changes from the first cam diameter d1 (FIG. 7) to the second cam diameter d2 (FIG. 6). As a result, the holder portion 58A of the spring holder 5E moves toward the second support shaft 60, whereby the compression springs 7 are placed in the non-compressed state. That is, the movement of the moving mechanism 6 to the non-operative position causes the cam 65 to pivot, whereby the compressed state of the compression springs 7 is cancelled so as not to apply the biasing force to the roller holder 5.

The biasing force of the compression springs 7 acts in the direction along the imaginary straight line 7X that passes the centerline of the compression springs 7. In the state in which the roller holder 5 is located at the pressing position, the imaginary straight line 7X extends so as to pass the axis 60X of the second support shaft 60 and the rotation axis 5X of the platen roller 5C. This configuration enables the biasing force of the compression springs 7 to stably act on the platen roller 5C disposed near the rear end portions of the compression springs 7 with the front end portions thereof stably held by the second support shaft 60 supported by the frame 2. Thus, the platen roller 5C is pushed onto the thermal head 3B by the biasing force that stably acts on the platen roller 5C, so that the positional relationship between the platen roller 5C and the thermal head 3B can be appropriately maintained.

Modifications

It is to be understood that the present disclosure is not limited to the details of the illustrated embodiment but may be embodied otherwise. In the illustrated embodiment, the protruding portion 532 of each bearing portion 5B is located on a diagonally rear left side with respect to the contact portion Pn of the platen roller 5C when viewed in the up-down direction. The protruding portion 532 of each bearing portion 5B may be located at substantially the same position as the contact portion Pn in the right-left direction. Only one of the bearing portions 5B may have the protruding portion 532. Each protruding portion 532 may be located at a position spaced away from the contact portion Pn in the right-left direction.

The configuration in which the roller holder 5 is held in contact with the head holder 3 in the second direction D2 while receiving the biasing force F2 from the compression springs 7 may be achieved by a structure other than the combination of the protruding portions 532 and the recesses 3C. For instance, the bearing portions 5B may have respective recesses which face the head holder 3, and the head holder 3 may have protruding portions protruding toward the respective bearing portions 5B. In this arrangement, when the roller holder 5 is located at the pressing position, the protruding portions of the head holder 3 are held in contact with wall portions of the respective recesses of the corresponding bearing portions 5B in the second direction D2.

The first support shaft 50 may include, at a part of its right end portion, partial flat portions configured to be respectively held in contact with the partial flat portions 5D of the inner circumferential surfaces of the corresponding through-holes 56 of the roller holder 5. The roller holder 5 may have, independently of the partial flat portions 5D, the structure in which the roller holder 5 is held in contact with the first support shaft 50 in the second direction D2 when the roller holder 5 receives the biasing force F2 from the compression springs 7. For instance, the roller holder 5 may have contact portions respectively provided on an outer surface of the upper plate 51A and an outer surface of the lower plate 51B, the contact portions being contactable with the first support shaft 50 in the second direction D2. In this case, each through-hole 56 may have a circular shape not having the partial flat portion 5D.

The compression springs 7 may be replaced with a leaf spring. In this case, the spring holder 5E may be omitted, and the cam 65 may directly compresses the leaf spring. The angle of inclination of the imaginary straight line 7X passing the centerline of the compression springs 7 with respect to the first direction D1 toward the second direction (D2) side is not limited to the angle in the illustrated embodiment.

In the illustrated embodiment, in the process of switching to the closed state of the lid 1B, the lever 6A comes into contact with the lid 1B, and the moving mechanism 6 is moved from the non-operative position to the operative position. The opening and closing operations of the lid 1B need not necessarily be in conjunction with the movement of the moving mechanism 6. For instance, the lever 6A may be manually operated by a user. The moving mechanism 6 may be moved between the non-operative position and the operative position by the manual operation of the lever 6A. In the illustrated embodiment, the moving mechanism 6 causes the cam 65 to change the position of the holder portion 58A of the spring holder 5E, thereby adjusting the biasing force of the compression springs 7 that acts on the roller holder 5. The printing apparatus 1 may employ a structure other than the cam, such as a link mechanism or a gear mechanism, configured to adjust the position of the holder portion 58A of the spring holder 5E and to thereby adjust the biasing force of the compression springs 7 that acts on the roller holder 5.

The imaginary straight line 7X extending along the centerline of the compression springs 7 may pass only one of the axis 60X of the second support shaft 60 and the rotation axis 5X of the platen roller 5C in the state in which the roller holder 5 is located at the pressing position. Further, the imaginary straight line 7X may pass neither the rotation axis 5X nor the axis 60X in the state in which the roller holder 5 is located at the pressing position.

In the illustrated embodiment, the cassette 9 is a tape cassette including the laminate tape. The cassette 9 may be a tape cassette not including the laminate tape such as a tape cassette used in performing printing on a base tape by use of the ink ribbon or a tape cassette including a heat-sensitive base tape. In this case, the base tape corresponds to the printing medium.

Others

Each protruding portion 532 is one example of a first contact portion of the present disclosure. Each compression spring 7 is one example of a biasing member of the present disclosure. Each partial flat portion 5D is one example of a second contact portion of the present disclosure.

What is claimed is:

1. A printing apparatus, comprising:

a frame:

a thermal head configured to perform printing on a printing medium;

a head holder holding the thermal head and fixed to the frame;

a platen roller opposed to the thermal head and configured to convey the printing medium in a predetermined conveyance direction with the printing medium nipped by and between the platen roller and thermal head;

a first support shaft fixed to the frame;

a roller holder rotatably supporting the platen roller, pivotally supported by the first support shaft, and including a first contact portion contactable with the head holder;

a moving mechanism configured to move the roller holder between a pressing position at which the platen roller is located close to the thermal head and a retracted position at which the platen roller is located away from the thermal head; and a biasing member configured to bias the roller holder in an inclined direction that is inclined with respect to a first direction toward a second direction side, the first direction being a direction which is substantially orthogonal to the conveyance direction and in which the platen roller faces the thermal head, the second direction being opposite to the conveyance direction, wherein the roller holder is configured such that, in a state in which the roller holder is located at the pressing position, the platen roller is held in contact with the thermal head while receiving a biasing force in the first direction from the biasing member, and the first contact portion is held in contact with the head holder in the second direction while receiving a biasing force in the second direction from the biasing member.

2. The printing apparatus according to claim 1, wherein the first contact portion is disposed close to a head contact portion of the platen roller that is in contact with the thermal head in the state in which the roller holder is located at the pressing position.

3. The printing apparatus according to claim 1, wherein the roller holder includes a second contact portion contactable with the first support shaft, and wherein the second contact portion is configured such that, in the state in which the roller holder is located at the pressing position, the second contact portion is held in contact with the first support shaft in the second direction while receiving the biasing force in the second direction from the biasing member.

4. The printing apparatus according to claim 1, wherein the first contact portion is a protruding portion that protrudes in the first direction, and wherein the head holder includes a wall portion with which the protruding portion comes into contact.

5. The printing apparatus according to claim 3, wherein the second contact portion is a flat portion having a flat surface, the flat portion being a part of an inner circumferential surface of a through-hole which is provided in the roller holder and through which the first support shaft passes.

6. The printing apparatus according to claim 1, wherein the biasing member is a compression spring, wherein, in a state in which the roller holder is located at the pressing position, the compression spring extends in the inclined direction that is inclined with respect to the first direction toward the second direction side, and wherein one of opposite end portions of the compression spring is in contact with the roller holder and the other of the opposite end portions thereof is in contact with the moving mechanism via a spring holder holding the compression spring.

7. The printing apparatus according to claim 6, wherein the moving mechanism is movable between an operative position and a non-operative position, and wherein, in a state in which the moving mechanism is located at the operative position, the moving mechanism compresses the compression spring via the spring holder and causes the roller holder to be located at the pressing position while causing the compressed compression spring to bias the roller holder, and wherein, in a state in which the moving mechanism is located at the non-operative position, the moving mechanism allows the roller holder to be located at the retracted position without compressing the compression spring via the spring holder.

8. The printing apparatus according to claim 7, wherein the moving mechanism includes a cam supported so as to pivot between the operative position and the non-operative position about a second support shaft fixed to the frame, and wherein the cam has a shape that allows a cam diameter to change from a first cam diameter corresponding to the operative position to a second cam diameter corresponding to the non-operative position, the cam diameter being a distance between a center of the second support shaft and a portion of the cam that is in contact with the spring holder.

9. The printing apparatus according to claim 8, wherein, in the state in which the roller holder is located at the pressing position, an imaginary straight line extending along a centerline of the compression spring passes an axis of the second support shaft and a rotation axis of the platen roller.

* * * * *